US005582874A

United States Patent [19]

Hyde

[11] Patent Number: 5,582,874

[45] Date of Patent: Dec. 10, 1996

[54] METHOD FOR COATING CORRUGATING ROLLS USING HIGH VELOCITY OXYGEN FUELED THERMAL SPRAY

[75] Inventor: Glenn F. Hyde, Timonium, Md.

[73] Assignee: United Container Machinery Group, Inc., Glen Arm, Md.

[21] Appl. No.: 347,794

[22] Filed: Nov. 29, 1994

[51] Int. Cl.[6] ..... C23C 4/06

[52] U.S. Cl. ..... 427/451; 427/450; 427/456; 492/20; 492/36

[58] Field of Search ..... 427/451, 450, 427/456; 492/54, 20, 36

[56] References Cited

U.S. PATENT DOCUMENTS

| | | | |
|---|---|---|---|
| 4,839,239 | 6/1989 | Ducos et al. | 427/422 |
| 4,986,181 | 1/1991 | Kobayashi et al. | 492/54 |

OTHER PUBLICATIONS

Union Carbide Article, Problem Solving Technology (UCAR coating applied by detonation gun extends wear life of corrugating rolls) 1990 (no month date).

HVOC–Spray Technology, Poised for Growth, Danial W. Parker and Gerald L. Kutner, General Plasma, Inc., reprinted from Apr. 1991 issue of Advanced Materials & Processes.

Tungsten Carbide coating enhances corrugator roll life article, 1993 International Paper Board Industry, Sep. 1993.

"Influence of Different Gases on the Mechanical and Physical Properties on HVOF Sprayed Tungsten Carbide Cobalt", T. Kraak, et al, Thermal Spray: International Advances in Coatings Technology, May–Jun./1992 pp. 153–158.

*Primary Examiner*—Katherine Bareford
*Attorney, Agent, or Firm*—Biebel & French

[57] ABSTRACT

A method for forming a hardened coating on a workpiece, such as a corrugating roll, having an undulated surface. A high velocity oxygen fueled gun is aligned with the undulated surface and a coating material is sprayed onto the surface from the gun to form a hardened coating having substantially uniform surface characteristics. The coating material is a tungsten carbide-cobalt material, or other hard carbide or oxide materials, which is sprayed onto the surface in a direction which is parallel to and offset from a plane passing through the longitudinal center of the roll. During the spraying operation, the gun is traversed along the length of the roll while the roll is rotated.

17 Claims, 3 Drawing Sheets

METHOD FOR COATING CORRUGATING ROLLS USING HIGH VELOCITY OXYGEN FUELED THERMAL SPRAY

BACKGROUND OF THE INVENTION

The present invention relates to corrugating rolls and, more particularly, to a method and apparatus for coating corrugating rolls whereby the rolls are provided with a hardened outer surface for resisting wear.

Corrugating rolls are used in machinery such as single facer or double facer corrugators which are used in the manufacture of corrugated paperboard. The corrugating rolls include a series of flutes formed around the circumference of the roll wherein the flutes are adapted to form corrugations in paper web during the formation of corrugated paperboard. In the manufacture of corrugating rolls, it is necessary to have a hard, wear resistant surface on the roll and the flute shapes and contours of the roll must be produced to close dimensional tolerances. In the manufacture of certain prior art rolls, the rolls were rough machined using ordinary cutting tools and then hardened by conventional heat treatment. The heat treatment tended to distort the machined roll such that a further operation of grinding was required to obtain the final desired dimensions for the flutes on the roll.

In order to extend the roll life, a hard exterior coating was typically applied to the surface of the roll to thereby increase its resistance to wear. Generally, chrome plating has been used to coat the outer surface of corrugating rolls, and such chrome plating has provided the desired result of increasing the life of the roll. However, there are problems associated with the use of chrome plating on rolls including the plating being susceptible to cracking and chipping. Once the surface of the roll has cracks or chips, the wear caused by the sliding of the paper web over the roll greatly increases, such that the useful life of the roll before it is either replaced or reground is significantly shortened.

Accordingly, there is a need for an improved corrugating roll surface which provides increased resistance to surface damage and which further provides an increased service life for the roll.

SUMMARY OF THE INVENTION

The present invention provides an improved method and apparatus for forming a hardened coating on a workpiece having an undulated surface, such as on a fluted corrugating roll.

In one aspect of the present invention, the method of forming the hardened coating includes aligning a high velocity oxygen fueled gun with the undulated surface and spraying a coating material onto the surface from the gun to form a hardened coating having substantially uniform surface characteristics. The hardened coating is preferably formed of a tungsten carbide-cobalt material. In addition, other coating materials may be incorporated into the present invention including coatings of chromium carbide, titanium carbide, silicon carbide and tribaloy (Co, Mo, Cr, Si) with binders such as nickel, nickel cadmium, molybdenum and the like.

In a further aspect of the invention, the gun is used to spray a coating on a fluted surface for a corrugating roll wherein the step of aligning the gun includes directing an outlet for the gun to spray along a line extending transverse to a line extending from the gun outlet diametrically through the roll. Thus, the spray of coating material is not directed along a diametrical line for the roll, but rather is directed at an angle in such a manner that only a portion of the flutes are sprayed at any given time.

In the preferred method of the present invention, the gun is located above a center line for the corrugating roll and is traversed along the length of the corrugating roll while the roll is rotated about its axis in a first direction. Subsequently, the gun is moved to a position below the center line for the roll and is traversed across the length of the roll while the roll is rotated in a second direction opposite to the first direction. The particular location of the gun above and below the center line for the roll is selected such that the desired uniform surface characteristics are produced on the surface of the roll.

By providing a uniform coating to the roll, the coated dimensions of the flutes are substantially close to the desired tolerances for the finished roll. Thus, subsequent to the operation of coating the roll, the finished surface for the roll may be provided by a honing operation without an intermediate grinding operation.

In addition, an apparatus is disclosed for performing the above-described steps for coating the roll. The apparatus includes a mount for holding the roll, a high velocity oxygen fueled gun and control means for moving the gun relative to the roll whereby the orientation and location of the gun relative to the roll is altered. The control means includes a first driver for moving the gun in a direction parallel to the longitudinal axis of the roll, and further includes a second driver for moving the gun in a direction perpendicular to a plane passing through the longitudinal axis of the roll. In addition, means are provided for rotating the roll while the roll is located on the mount.

Therefore, it is a primary object of the present invention to provide a method for forming a hardened coating having substantially uniform surface characteristics on a corrugating roll using a high velocity oxygen fueled gun.

Other objects and advantages of the invention will be apparent from the following description, the accompanying drawings, and the appended claims.

DETAILED DESCRIPTION OF THE PREFERRED EMBODIMENT

Figure 1:
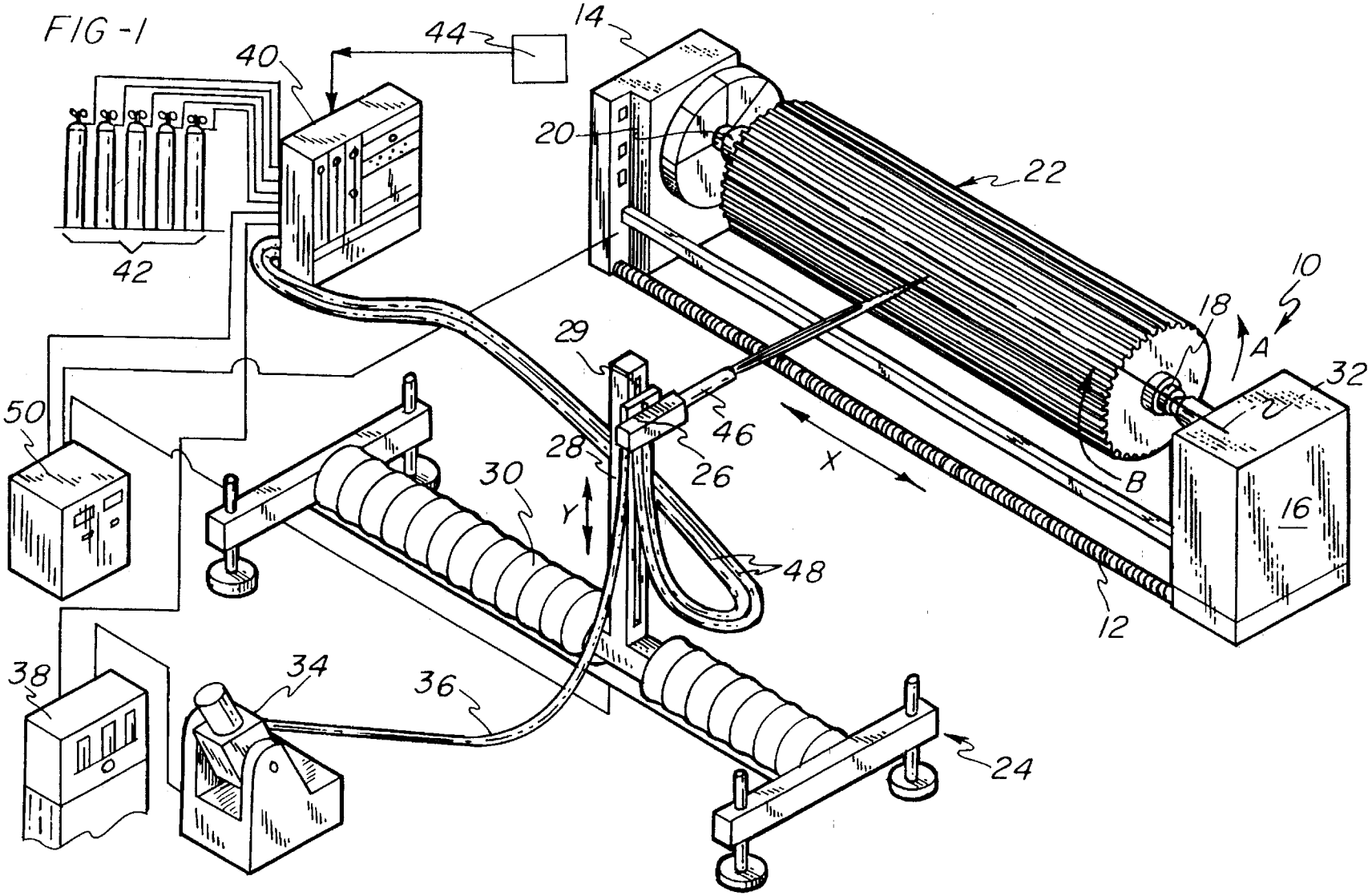
FIG. 1 illustrates an apparatus for forming a hardened coating on a corrugating roll in accordance with the present invention.

The present invention is directed toward providing a workpiece having discontinuous or undulated surface with a hardened coating formed of a tungsten carbide-cobalt material. Further, it should be noted that although the present invention is described with reference to providing such a coating to a corrugating roll, this invention is intended to encompass other applications, such as applying a coating to gear teeth, splines or other workpieces having undulated surfaces.

It is desirable to coat corrugating rolls with a tungsten carbide-cobalt surface coating or other hard coating materials including chromium carbide, titanium carbide, boron carbide, silicon carbide, aluminum oxide and tribaloy (Co, Mo, Cr, Si) with binder materials such as cobalt, nickel, nickel chromium, molybdenum and the like. These coatings provide the surface of the corrugating roll with an optimum hardness which is able to withstand both abrasive and erosive wear as well as to be resistant to impact. Although carbide coatings have been used for several different applications in order to provide extended life for tooling, the application of such a coating to fluted corrugating rolls, as well as other discontinuous or undulating surfaces, has proven to be difficult. For example, carbide coatings typically form a rough non-uniform outer surface in their as-deposited condition on the corrugating roll flutes, and the thickness of the coating normally tends to be significantly greater in the gullet of the flute, as compared to the thickness at the flute tip.

Further, the inherent hardness of such carbide coatings makes them resistant to grinding with conventional grinding tools. For example, grinding operations performed on tungsten carbide or other carbides and oxides typically involve using diamond either as a grinding wheel or as a diamond lapping compound. In the case of grinding fluted corrugating rolls, the diamond grinding wheel must be provided with a shape which conforms to the shape of the flutes forming the roll. However, during the grinding operation, the diamond grinding wheel loses its shape and dimensional control such that a diamond grinding wheel for all practical purposes is not capable of providing the desired dimensional tolerances for the flutes. It should further be noted that, unlike conventional grinding tools, it is not possible to dress a diamond wheel such that diamond wheels configured to grind the fluted areas cannot be reused once they lose their dimensional tolerances.

Therefore, it should be apparent that a corrugating roll coated with tungsten carbide must be substantially within the desired tolerances at the end of the coating operation or the finishing operation for the roll may become prohibitively expensive. In accordance with the present invention, a method has been developed for applying a tungsten carbide-cobalt material (or other hard carbides or oxides with binders of nickel, nickel chromium, nickel Cr Mo, etc.) to the roll wherein the coating has substantially uniform surface characteristics such that minimal surface irregularities are present. In addition, the present invention provides a coating which is sufficiently uniform to ensure that any variations in the thickness of the coating between the gullets and tips of the flutes are maintained within a desired tolerance whereby the finished surface of the roll may be produced through a honing operation without requiring an intermediate grinding operation.

Referring to FIG. 1, an apparatus 10 for performing the coating operation is illustrated. The apparatus 10 includes a roll mount 12 having opposing first and second end supports 14, 16. The end supports 14, 16 include respective support shafts 18, 20 for supporting the opposing ends of a fluted corrugating roll 22.

The apparatus 10 further includes a spray gun support 24 for supporting a high velocity oxygen fueled (HVOF) gun 26. The HVOF gun 26 essentially uses an internal combustion jet to produce hypersonic gas velocities for spraying the tungsten carbide-cobalt which is fed in powder form into the jet. For example, a mixture of 88 wt % tungsten carbide to 12 wt % cobalt is satisfactory for use in the present method. The jet may be fueled by various gaseous and liquid hydrocarbons such as for example kerosene, napthaleen, propylene, acetylene, propane, map gas or hydrogen and others in combination with oxygen. In the preferred embodiment, either hydrogen or kerosene are used. Further, the gun 26 may be any one of several high velocity oxygen fueled guns which are commercially available such as, for example, a JP 5000 gun sold by Hobart Tafa Technologies Inc. of Concord, N.H.

The gun 26 is supported on a vertical mounting bar 28 and the vertical mounting bar 28 is supported on a first driver 30 which is adapted to traverse the spray gun 26 along the roll 22 in a horizontal direction X parallel to a longitudinal axis 32 of the roll 22. In addition, the mounting bar 28 includes a second driver 29 for driving the spray gun 26 in a vertical direction Y along the bar 28. Further, the roll 22 is preferably driven for rotational movement by a further driver, such as a motor, located within one of the end supports 14, 16. The means for moving the gun 26 relative to the roll 22 may be a commercially available apparatus, such as a BUG-O unit sold by Weld Tooling Corp. of Pittsburgh, Pa. The BUG-O unit includes a guide track incorporating a screw thread, rotation of the screw thread causing precisely controlled horizontal movement of a device, such as the gun 26, along the track. It should also be noted that vertical movement of the gun 26 may be controlled by conventional means such as a rotatable screw thread mounted in the bar 28, or other known means for providing vertical translational movement.

The gun 26 is supplied with tungsten carbide-cobalt powder or other carbide or oxide powders from a powder feeder 34 through a flexible hose 36 connected to the gun 26. The powder feeder 34 is controlled by a powder feeder control console 38. In addition, an oxygen/fuel/cooling water control console 40 is provided for supplying oxygen and fuel from supply tanks 42 to the gun 26, and for supplying cooling water from a water treatment and cooling station 44 to a water cooled nozzle 46 defining an outlet for the gun 26. The oxygen, fuel and water are supplied to the gun 26 through flexible supply lines 48.

A central programmable controller 50 is connected to each of the control consoles 38 and 40 and is further connected to the drives for moving the gun 26 and for rotating the corrugating roll 22. The controller 50 coordinates the different operations including the movement of the gun 26 and the roll 22 and actuation of the gun 26 to spray the tungsten carbide-cobalt material onto the roll 22 in accordance with the method of the present invention, as will be described further below.

Figure 2:
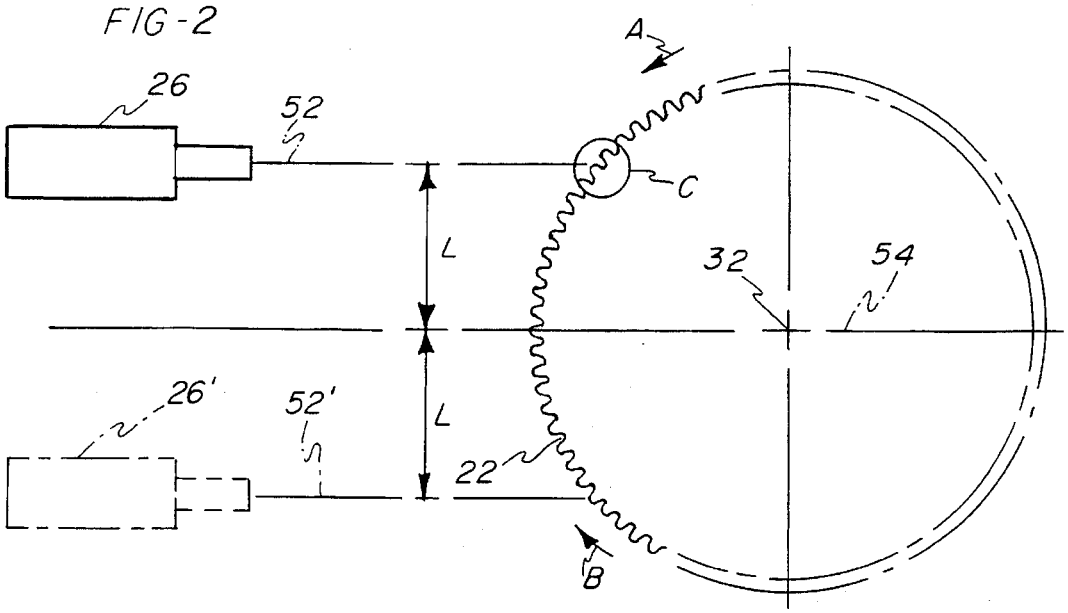
FIG. 2 is a diagrammatic view of the relationship between the corrugating roll and the gun for spraying the coating in the two positions of the gun above and below the center line for the corrugating roll.

Referring to FIGS. 1 and 2, a typical coating operation in accordance with the present invention is performed by aligning the gun 26 such that a center line 52 of the nozzle 46 extends parallel to a plane 54 extending diametrically through the corrugating roll 22 and passing through the longitudinal axis 32 wherein the plane 54 is substantially horizontal. The gun 26 is located on the mounting bar 28 at a vertical position which is a predetermined distance L above the plane 54.

Figure 3:
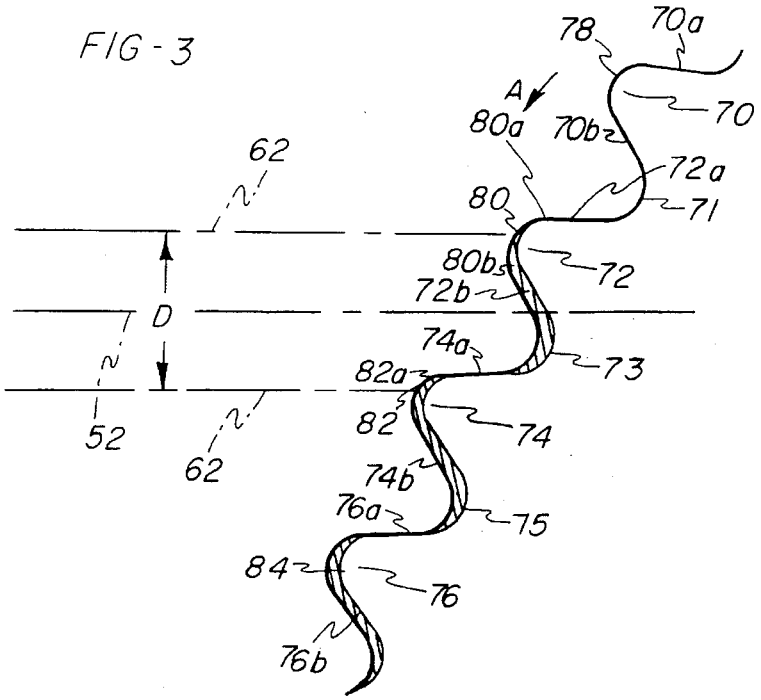
FIG. 3 is an enlarged view of area C in FIG. 2.

Referring further to FIG. 3, an enlarged view of flutes 70, 72, 74, 76 is shown wherein the flutes 70, 72, 74 and 76 include respective flute tips 78, 80, 82 and 84. Flanks **70*a*, 70*b*, 72*a*, 72*b*, 74*a*, 74*b*, 76*a*, 76*b*** extend from the flute tips 78, 80, 82, 84 down to gullets 71, 73, 75, respectively. As shown in FIG. 3, the diameter D of the spray 62 is such that it will generally cover a flute tip half 80*b*, a flank 72*b*, a gullet 73 and another flute tip half 82*a*. In other words, the spray diameter D is sufficient to span a full flute tip width, a flank and a gullet.

Further, it should be noted that the position of the gun 26 is selected such that the spray 62 propelled from the gun 26 has a trajectory substantially parallel to adjoining flanks 72*a* and 74*a* while impinging substantially directly on the flank 72*b*, tip halves 80*b* and 82*a*, and gullet 73. Thus, only a portion of each flute is selectively coated with the gun 26 positioned above the plane 54.

Referring again to FIG. 3, it can be seen that flute 76 is illustrated as having passed through the spray 62 such that substantially the entire flute tip 84 has been coated whereas the flute tip half 80*a* and flute 70 have not been coated since this portion of the roll has not passed through the spray 62 in its rotation in the direction A. In addition, it should be noted that with the gun 26 located in this position and activated to spray the corrugating roll 22, the driver 30 is activated to traverse the gun 26 along the length of the roll 22. Simultaneously, the driver within either of the end supports 14, 16 causes the roll 22 to rotate a plurality of times in the direction A, as shown in FIG. 2.

At the end of a traverse along the length of the roll 22, the gun-26 is moved to the position shown by the gun 26' in FIG. 2. As shown, the gun 26' is located a distance L below the horizontal plane 54 whereby the flank portion 74*a*, located on the opposing side of the gullet 73 from the flank 72*b*, will be coated. During this portion of the coating operation the gun 26 will be traversed along the length of the roll 22 while the roll 22 is rotated in a second direction B opposite to the first direction A. Thus, during coating of the roll, the roll 22 will be rotated such that surfaces being coated by the spray will move in a direction toward the spray.

It has been found that by aligning the gun 26 offset from the longitudinal axis 32, a desirable distribution of the tungsten carbide-cobalt material on the flutes is obtained. Specifically, the above-described alignment of the gun 26 facilitates limiting of the amount of material deposited in the gullets while also providing for increased material deposition on flanks and tips of the flutes. The present method of coordinating the alignment and movements of the gun 26 relative to the roll 22 further ensures that the deposited material has substantially uniform surface characteristics without the inherent roughness typically associated with carbide coatings such that the coated surface is easily finished using a honing operation.

Figure 4:
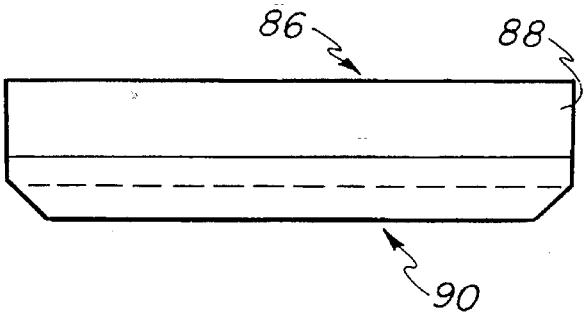
FIG. 4 is a side elevational view of a honing tool for use in honing a corrugating roll coated according to the present invention.
Figure 5:
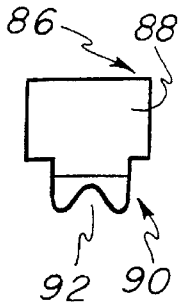
FIG. 5 is an end elevational view of the honing tool of FIG. 4.
Figure 6:
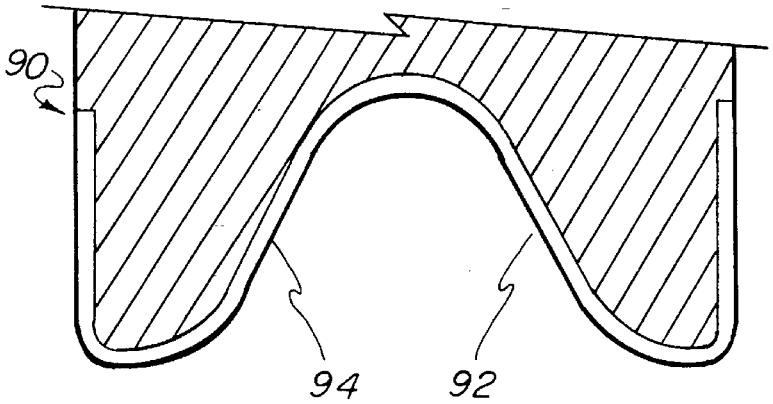
FIG. 6 is an enlarged cross-sectional end view of the honing portion of the honing tool for the present invention.

The honing process may be performed using a bar-shaped honing tool 86, such as is illustrated in FIGS. 4 and 5. The honing tool 86 is preferably formed with a steel base 88 including a shaped honing portion 90. As is further illustrated in FIG. 6, the honing portion 90 is provided with a gullet-shaped indentation 92 which is configured to hone a flute including the flute tip, both flanks and one-half the adjacent gullets. In addition, the honing portion 90 includes a diamond surface coating 94 forming the working surface of the honing tool.

In use, the honing tool may be mounted in a conventional honer which is commercially available, such as the Supfina SE40 sold by Supfina Machine Co., Inc. of Warwick, R.I., which vibrates the honing tool 86 as it is moved along the length of the flutes for the corrugating roll. When used on a corrugating roll coated in accordance with the present invention, the present honing tool 86 smoothes the coated surface to produce the final flute dimensions required for the finished corrugating roll.

It should be noted that this process for coating a roll provides a desired coating thickness at each portion of the flute such that subsequent grinding is not required. Thus, the honing operation may be performed immediately after the coating operation in order to provide the finished surface for the corrugating roll 22 without performing an intermediate grinding operation.

In addition, it should be understood that the above-described steps for the present method may be varied within the scope of this invention. For example, the position of the gun 26 relative to the plane 54 may be held constant for multiple traversing passes along the length of the roll prior to moving the gun 26 to the position illustrated by gun 26'. Further, control of the angle at which the spray 62 impinges upon the roll 22 may be accomplished by angling the gun 26 upwardly or downwardly relative to the plane 54 in addition to or instead of moving the gun vertically.

Further, it should be noted that the present use of HVOF tungsten carbide-cobalt coating process provides a desirable process for coating the rolls wherein the maximum temperature of the roll is limited. In particular, it has been found that the present process provides the roll with a carbide coating while maintaining the temperature of the roll below 300° F. such that tempering (resulting in softening of the substrate) or distortion of the flutes from either warpage of the roll or melting of the flutes is avoided.

Also, it should be understood that, prior to coating a roll in accordance with the process of the present invention, the roll is grit blasted to attain a uniformly roughened surface finish whereby mechanical adhesion of the coating to the roll surface is promoted. It is important that the blasting be performed uniformly to the tips, flanks and gullets, and the process may be performed using $Al_2O_3$ grit or other hard mineral particles.

From the above description, it should be apparent that the present invention provides a method for coating workpieces having a discontinuous or undulating surface, for example, the present coating method may be applied to corrugating rolls, gears, ratchets and similar workpieces.

While the method herein described constitutes a preferred embodiment of this invention, it is to be understood that the invention is not limited to this precise method, and that changes may be made therein without departing from the scope of the invention, which is defined in the appended claims.

What is claimed is:

1. A method of forming a hardened coating on a substantially cylindrical workpiece defining a longitudinal axis extending through the center of the workpiece and having an undulated surface, the method comprising the steps of:

aligning a nozzle of a high velocity oxygen fueled gun with said undulated surface; and spraying a coating material onto said surface from said gun to form a hardened coating;

wherein said undulating surface includes a plurality of elongated tips and gullets extending in a longitudinal direction, and flanks extending between adjacent tips and gullets, and said hardened coating is deposited to a substantially uniform thickness on said tips, gullets and flanks during said spraying step; and said step of aligning said nozzle of said gun comprises aligning a centerline of the outlet of said nozzle along a line displaced from said longitudinal axis whereby said centerline of the outlet said nozzle is aligned substantially parallel to at least one of said flanks and such that said at least one flank is located in an area being sprayed with said coating material.

2. The method as in claim 1 wherein said coating material is a tungsten carbide-cobalt material.

3. The method as in claim 2 including the step of honing said coating material.

4. The method as in claim 1 including the step of traversing said gun along said longitudinal axis during said step of spraying said coating material.

5. The method as in claim 1 wherein said spraying step comprises spraying a flank adjacent to said at least one flank while leaving said at least one flank substantially uncoated and, subsequently, redirecting said nozzle to coat said at least one flank.

6. The method as in claim 5 including the step of traversing said gun along said longitudinal axis during said step of spraying said coating material.

7. The method as in claim 6 including the step of rotating said workpiece about said longitudinal axis during said step of traversing said gun.

8. The method as in claim 6 wherein said step of aligning said nozzle of said gun comprises aligning said centerline of the outlet of said nozzle in spaced relation to a side of a plane passing diametrically through said roll and extending parallel to and containing said longitudinal axis and directing said nozzle to spray parallel to said plane, and subsequently, moving said centerline of the outlet of said nozzle into spaced relation to an opposite side of said plane.

9. The method as in claim 1 wherein said workpiece is a corrugating roll and said coating material is a tungsten carbide-cobalt material.

10. A method of coating a corrugating roll defining a longitudinal axis extending through the center of the corrugating roll and said corrugating roll having an undulated surface defined by alternating tips and gullets with flanks extending between said tips and gullets, the method comprising the steps of:

aligning a nozzle of a high velocity oxygen fueled gun with said surface;

spraying a tungsten carbide-cobalt material onto said surface from said gun to form a hardened coating having substantially uniform surface characteristics; and wherein said step of aligning said nozzle of said gun includes aligning a centerline of the outlet of said nozzle along a first line extending transverse to a line extending from said nozzle diametrically through said roll whereby said centerline of the outlet of said nozzle is aligned substantially parallel to at least one of said flanks and such that said at least one flank is located in an area being sprayed with said coating material.

11. The method as in claim 10 including the step of traversing said gun along said longitudinal axis during said step of spraying said material.

12. The method as in claim 11 including the step of rotating said roll in a first direction about said longitudinal axis during said step of spraying said material.

13. The method as in claim 12 including the step of aligning said centerline of the outlet of said nozzle along a second line extending transverse to a line extending from the outlet of said nozzle diametrically through said roll and rotating said roll in a second direction opposite to said first direction during said step of spraying said material.

14. The method as in claim 13 wherein said gun traverses said roll a plurality of times and said roll rotates a plurality of times during each traverse of said gun.

15. The method as in claim 10 wherein said step of aligning said nozzle further includes locating said nozzle in a first position in spaced relation to a side of a plane passing diametrically through said roll and extending parallel to and containing said longitudinal axis and aligning said centerline of the outlet of said nozzle parallel to said plane.

16. The method as in claim 15 wherein said step of aligning said nozzle further includes moving said nozzle to a second position in spaced relation to an opposite side of said plane and aligning said centerline of the outlet of said nozzle parallel to said plane.

17. The method as in claim 16 including the step of rotating said roll during said step of spraying said material, wherein said roll is rotated in a first direction when said nozzle is located in said first position, and said roll is rotated in a second opposite direction when said nozzle is located in said second position.

* * * * *